US007401391B2

(12) United States Patent
Maple et al.

(10) Patent No.: US 7,401,391 B2
(45) Date of Patent: Jul. 22, 2008

(54) DISH ASSEMBLY FOR CASKET CAP AND METHOD

(75) Inventors: Donald D. Maple, Batesville, IN (US); Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 97 days.

(21) Appl. No.: 11/549,152

(22) Filed: Oct. 13, 2006

(65) Prior Publication Data

US 2008/0086855 A1 Apr. 17, 2008

(51) Int. Cl.
*A61G 17/00* (2006.01)

(52) U.S. Cl. ..... 27/19

(58) Field of Classification Search ..... 27/19, 27/14, 2; D99/10, 8, 12
See application file for complete search history.

(56) References Cited

U.S. PATENT DOCUMENTS 1,931,828 A 10/1933 Overstreet
4,357,741 A 11/1982 Winburn et al.
5,495,648 A * 3/1996 Rojdev et al. ..... 27/19
5,636,419 A * 6/1997 Foye ..... 27/19
5,675,877 A 10/1997 Lewis
5,709,016 A * 1/1998 Gulick et al. ..... 27/2
6,237,202 B1 * 5/2001 Agee et al. ..... 27/14
6,742,231 B1 * 6/2004 Calhoun et al. ..... 27/19
7,159,287 B2 * 1/2007 Parker et al. ..... 27/19
2005/0150091 A1 * 7/2005 Parker et al. ..... 27/19

* cited by examiner

*Primary Examiner*—William L. Miller
(74) *Attorney, Agent, or Firm*—Wood, Herron & Evans, LLP

(57) ABSTRACT

A dish assembly for a casket cap comprises a cap panel having a pair of opposed sides, a puffing member attached to each side of the pair of sides of the cap panel along respective adjacent edges of the puffing member and cap panel side, a cap panel insert having a pair of opposed sides and being removably inserted between the puffing members and juxtaposed relative to the cap panel, a retention member fixedly secured to one of the sides of the cap panel insert and removably inserted between the respective adjacent edges of one of the puffing members and a respective one of the cap panel sides, and a pull member fixedly secured to the other of the sides of the cap panel insert and projecting away from the cap panel. The retention member and the puffing members retain the cap panel insert in juxtaposition relative to the cap panel, and the pull member enables the cap panel insert to be pulled out from between the puffing members, away from the cap panel, and out of the dish assembly.

25 Claims, 9 Drawing Sheets

DISH ASSEMBLY FOR CASKET CAP AND METHOD

FIELD OF THE INVENTION

Figure 1:
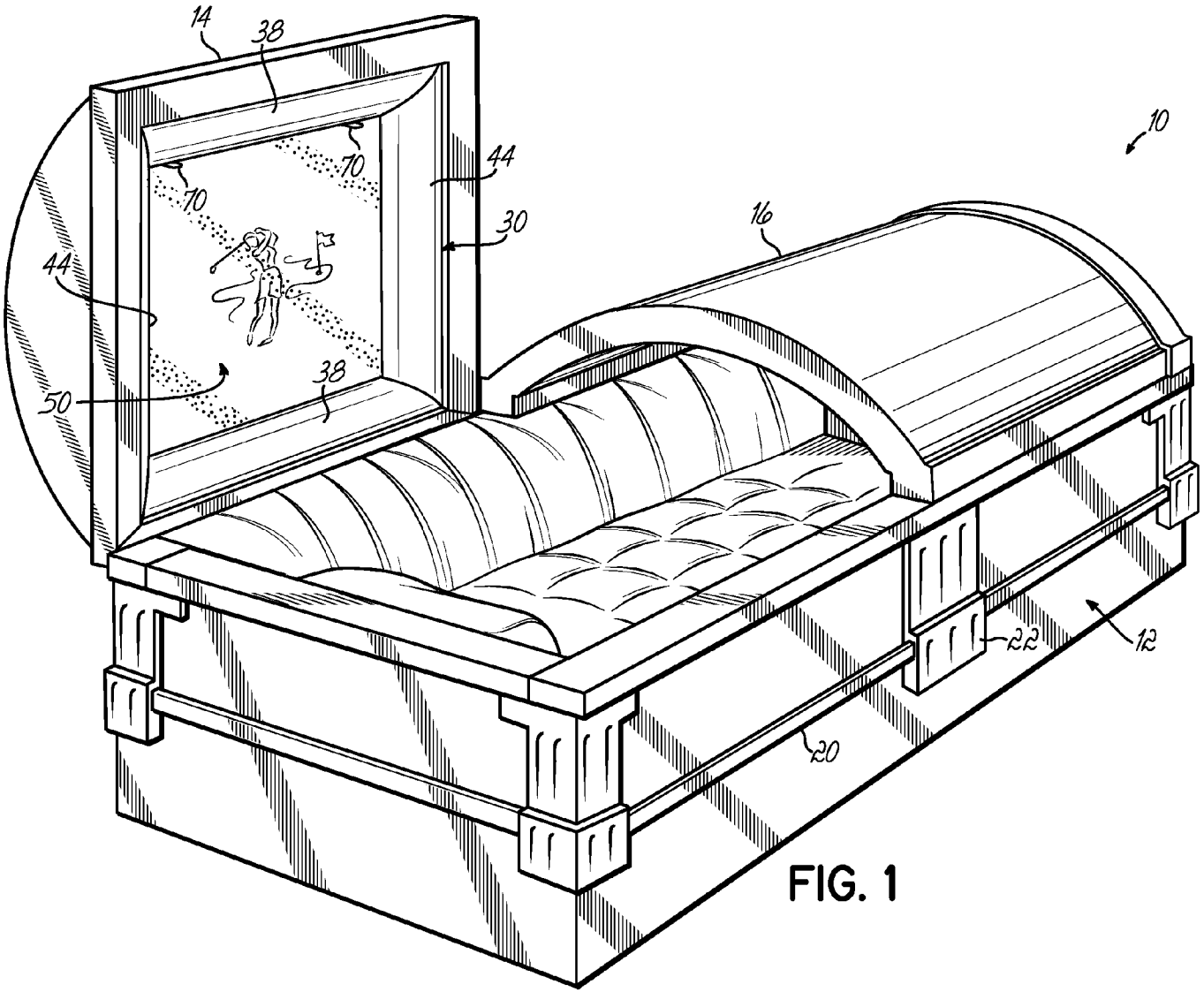

This invention relates generally to caskets, and more particularly to dish assemblies for casket caps or lids.

BACKGROUND OF THE INVENTION

Caskets traditionally comprise a shell to which is pivoted a cap or lid. During viewing of the deceased in the casket, the cap is of course pivoted to its open position to permit relatives, loved ones, acquaintances and the like to view the deceased. During this time the underside of the casket cap is visible. It is thus desirable to trim the underside of the cap with decorative trim. This has been traditionally accomplished with the installation of a dish assembly into the underside of the cap.

The traditional dish assembly has taken the form of a rectangular cap panel having two long sides and two short sides, with a puffing member being attached to each of the four sides. The cap panel is positioned in the casket cap atop a standoff, itself positioned in the cap, or atop a ridge or groove forming a part of the cap. The free edges of the puffing members are retained in a peripheral groove in the casket cap near the peripheral edge of the cap. The puffing members are so sized as to require them to assume a convex shape for their free edges to be retained in the peripheral groove. A rectangular cap panel insert, including decorative embroidery or the like, is installed between the four puffing members and in juxtaposition relative to the cap panel. Friction between the four puffing members and the four side edges of the cap panel insert has been employed to secure the cap panel insert into the dish assembly. This technique has not met with complete satisfaction as, depending on the force with which the cap closes upon the shell, the cap panel insert can become dislodged from the dish assembly and fall upon the deceased.

Other more elaborate means of securing the cap panel insert into the dish assembly have been employed. It is desirable however to employ a means of attachment which permits removable securement of the cap panel insert into the dish assembly to allow various inserts to be presented to a purchaser of the casket. Quite often, a customer will desire to view a number of different inserts in a dish assembly during the casket selection process, with each insert having a different embroidered pattern, or different fabric, thereon. Therefore it is desirable to be able to quickly remove one cap panel insert from the dish assembly of a casket cap and to replace it with another insert for selection purposes.

One technique for removably installing a cap panel insert into a dish assembly is disclosed in Winburn et al. U.S. Pat. No. 4,357,741, assigned to the assignee of the present invention, and incorporated by reference herein as if fully set forth in its entirety. The Winburn patent discloses the use of a pair of elongated straps secured to a cap panel insert to facilitate installation of the insert into the dish assembly. The straps are spaced along the length of the insert and are fixedly or permanently secured to the insert near the lower ends of the straps. Near the upper ends of the straps the straps are removably secured to the insert via fasteners. The straps are longer than the height of the insert so that a portion of each strap protrudes above and below the top and bottom edges of the insert. To install the insert into a dish assembly, the bottom strap portions are inserted between the cap panel and the bottom puffing. The insert is angled outwardly from the cap, i.e. toward an installer, during which time the upper ends of the straps are not connected to the insert, and the top strap portions are inserted between the cap panel and the top puffing. The straps are flexible enough to allow bowing of the straps to slip the top strap portions into place. The insert is then pivoted into place against the cap panel and the fasteners attached to the insert are fastened to the fasteners attached near the upper ends of the straps. The straps cannot be permanently attached to the insert at both the upper and lower locations as the insert, normally fabricated of a rigid substrate, cannot be flexed or bowed to the extent required to slip the strap ends into place.

A difficulty associated with the Winburn technique is that an installer must work over the top edge of the cap panel insert, which is pivoted outwardly and into the face of the installer, to insert and remove the upper strap ends to and from between the cap panel and the top puffing. Thus installation is somewhat awkward and not as swiftly accomplished as would be desired.

Another technique for removably installing a cap panel insert into a dish assembly is disclosed in Lewis U.S. Pat. No. 5,675,877, assigned to the assignee of the present invention, and incorporated by reference herein as if fully set forth in its entirety. The Lewis patent discloses a dish assembly for a casket which comprises a generally rectangular cap panel having a pair of opposed sides, a puffing member attached to each side of the pair of sides along respective adjacent edges of the puffing member and side, a cap panel insert removably inserted between the puffing members and juxtaposed relative to the cap panel, a tab removably inserted between the respective adjacent edges of each attached puffing member and side, and a first portion of a fastener attached to the tab and a second portion of the fastener attached to the cap panel insert. The first and second portions of the fastener are removably secured one to another such that the cap panel insert is removably secured to the cap panel of the dish assembly. The fastener can be a hook and loop type fastener.

A difficulty associated with the Lewis technique is that sometimes the hook and loop fasteners hold the cap panel insert to the cap panel too well, making it somewhat difficult to quickly remove the cap panel insert for replacement with another insert. Another difficulty is that the tabs can become lost or misplaced.

Accordingly, improvements are still desired in the installation and removal of cap panel inserts into and from dish assemblies.

SUMMARY OF THE INVENTION

In one aspect, the invention is a dish assembly for a casket cap. The dish assembly comprises a cap panel having a pair of opposed sides, a puffing member attached to each side of the pair of sides of the cap panel along respective adjacent edges of the puffing member and cap panel side, a cap panel insert having a pair of opposed sides and being removably inserted between the puffing members and juxtaposed relative to the cap panel, a retention member fixedly secured to one of the sides of the cap panel insert and removably inserted between the respective adjacent edges of one of the puffing members and a respective one of the cap panel sides, and a pull member fixedly secured to the other of the sides of the cap panel insert and projecting away from the cap panel. The retention member and the puffing members retain the cap panel insert in juxtaposition relative to the cap panel, and the pull member enables the cap panel insert to be pulled out from between the puffing members, away from the cap panel, and out of the dish assembly.

The respective adjacent edges of the puffing members and cap panel sides can be secured together with staples, and the members can be secured to the cap panel insert with staples. The retention and pull members can be stapled to a back face of the cap panel insert. The retention and pull members can be tabs. The cap panel can be generally rectangular and have a pair of opposed long sides and a pair of opposed short sides. A puffing member can be attached to each side of the pair of long sides and pair of short sides of the cap panel. The cap panel insert can be generally rectangular and have a pair of opposed long sides and a pair of opposed short sides. A pair of the retention members can be spaced apart and secured to one of the long sides of the cap panel insert, and a pair of the pull members can be spaced apart and secured to the other of the long sides of the cap panel insert.

In another aspect, the invention is a casket comprising a casket shell, a casket cap pivoted to the shell, and the dish assembly of above mounted in the cap.

In yet another aspect, the invention is a method of assembling a dish assembly for a casket cap. The method comprises the steps of providing a cap panel having a pair of opposed sides, providing at least two puffing members, attaching one of the puffing members to each of the pair of sides along respective adjacent edges of the puffing member and side, providing a cap panel insert having a pair of opposed sides corresponding to the cap panel opposed sides, providing a retention member and fixedly securing the retention member to one of the sides of the cap panel insert, providing a pull member and fixedly securing the pull member to the other of the sides of the cap panel insert, removably inserting the retention member between the respective adjacent edges of one of the puffing members and a respective one of the cap panel sides, projecting the retention member away from the cap panel, and removably inserting the cap panel insert between the puffing members and juxtaposing the cap panel insert relative to the cap panel.

In still another aspect, the invention is a dish assembly for a casket cap comprising a cap panel having a first side and a second side opposite the first side, and a third side and fourth side opposite the third side, a puffing member attached to each side of the cap panel along respective adjacent edges of the puffing member and cap panel side, a cap panel insert having a first side and a second side opposite the first side, and a third side and a fourth side opposite the third side, a retention member fixedly secured to the first side of the cap panel insert and removably inserted between the respective adjacent edges of one of the puffing members and a respective one of the cap panel sides, and a pull member fixedly secured to one of the second, third, and fourth sides of the cap panel insert and projecting away from the cap panel, whereby the retention member and the puffing members retain the cap panel insert in juxtaposition relative to the cap panel, and the pull member enables the cap panel insert to be pulled out from between the puffing members, away from the cap panel, and out of the dish assembly.

The pull member can be secured to the second, third, or fourth side of the cap panel insert. The cap panel and cap panel insert can be generally rectangular. The retention and pull members can be tabs. The pull member can be a cord.

In other embodiments, the pull tab can have a strip of foam rubber secured thereto to provide additional friction between the tab and the puffing member. The cap panel insert can comprise a rigid substrate, a strip of open cell poly foam positioned around a perimeter of the substrate, and a fabric covering securing the foam strip to the substrate, the foam strip providing additional friction between the edges of the cap panel insert and the puffing members. The pull member can be a cord and the cap panel insert can include a tab secured thereto adjacent the cord providing additional friction between the cap panel insert and puffing member. The retention member can be a leg having a first portion secured to the cap panel insert, a second offset portion which projects toward the cap panel, and a third portion which projects downwardly from the offset portion. The leg adapts the cap panel insert to be mounted in the dish when the dish includes a coved cap panel.

The casket, dish assembly, and method of the invention thus overcome the difficulties associated with prior attempts at providing quick installation and removal of cap panel inserts into and from dish assemblies.

These and other features and advantages of the present invention will become more readily apparent during the following detailed description taken in conjunction with the drawings herein, in which:

BRIEF DESCRIPTION OF THE DRAWINGS OF THE INVENTION

Figure 2A:
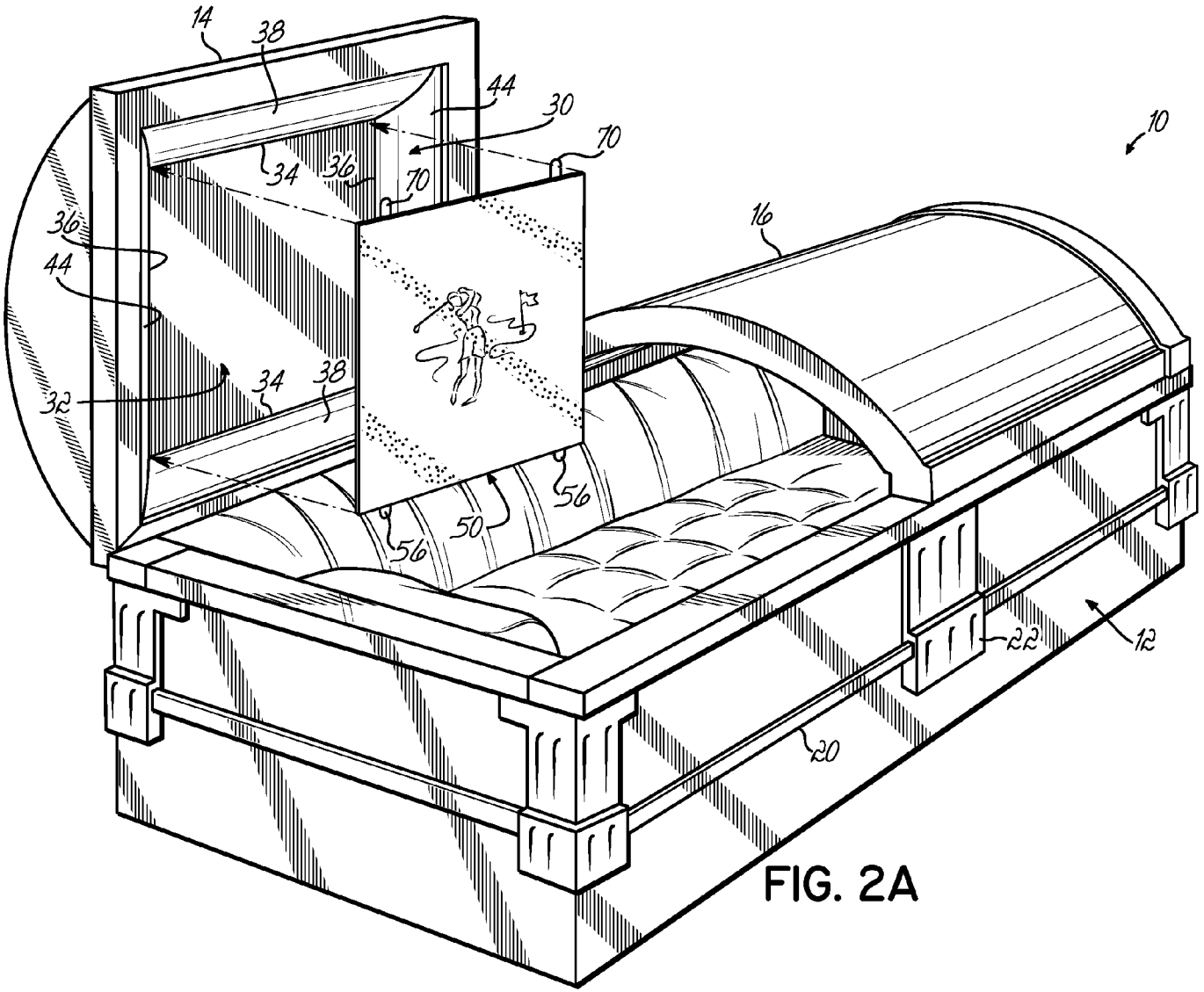
Figure 2B:
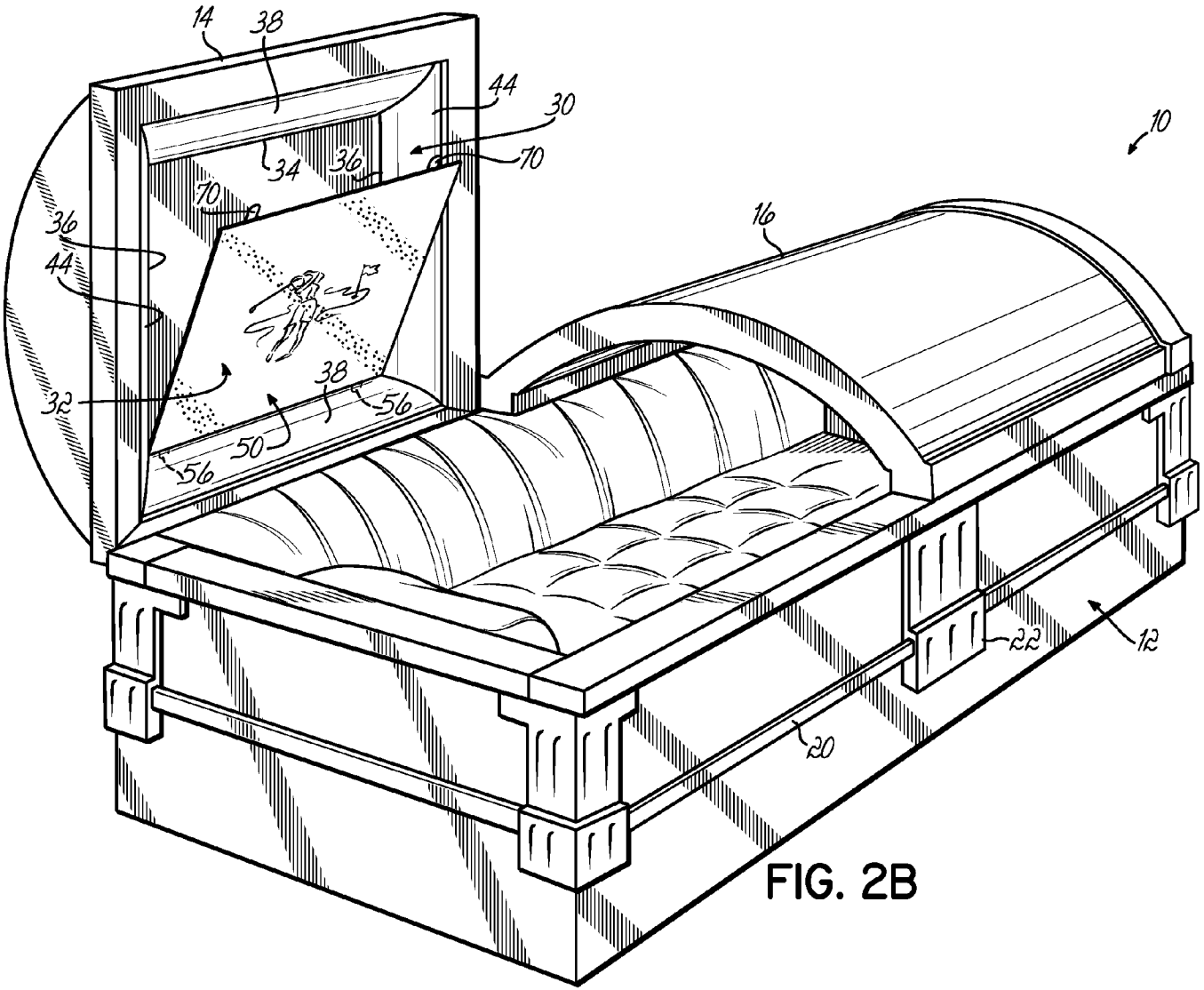
Figure 3:
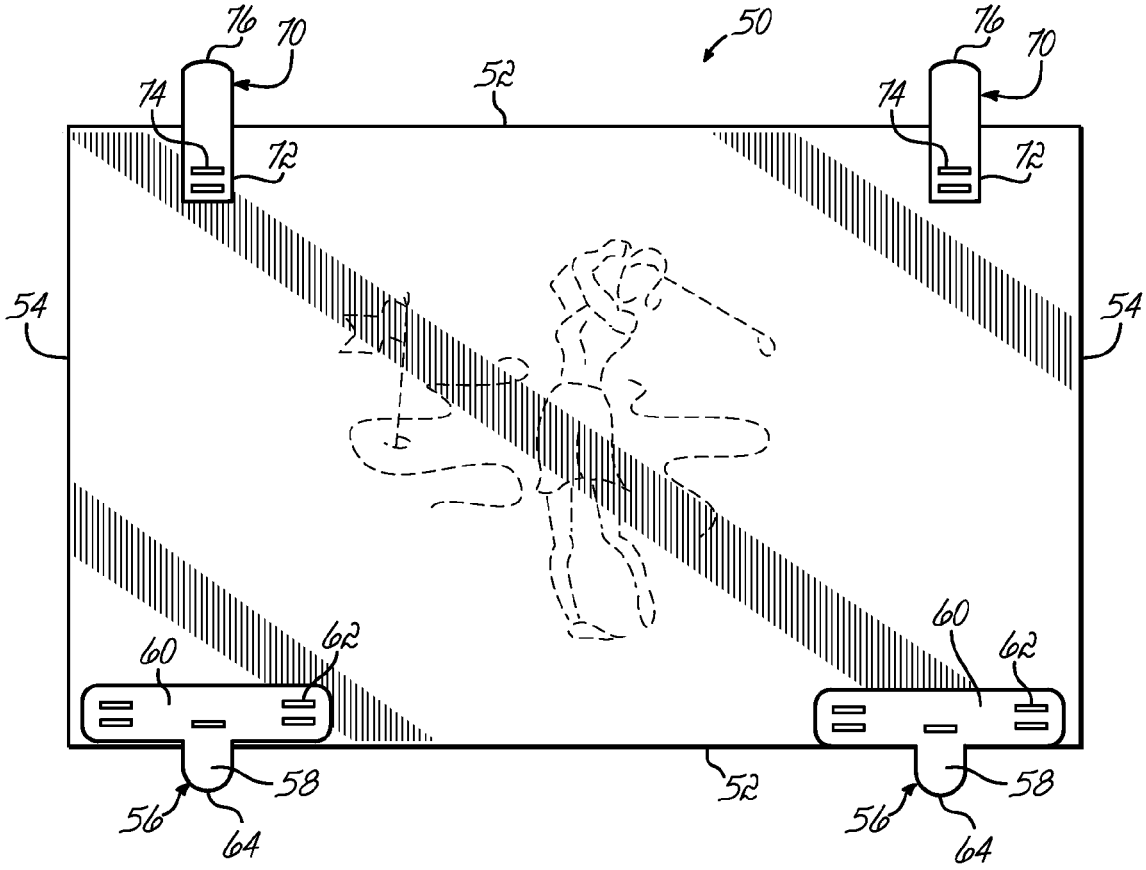
Figure 4A:
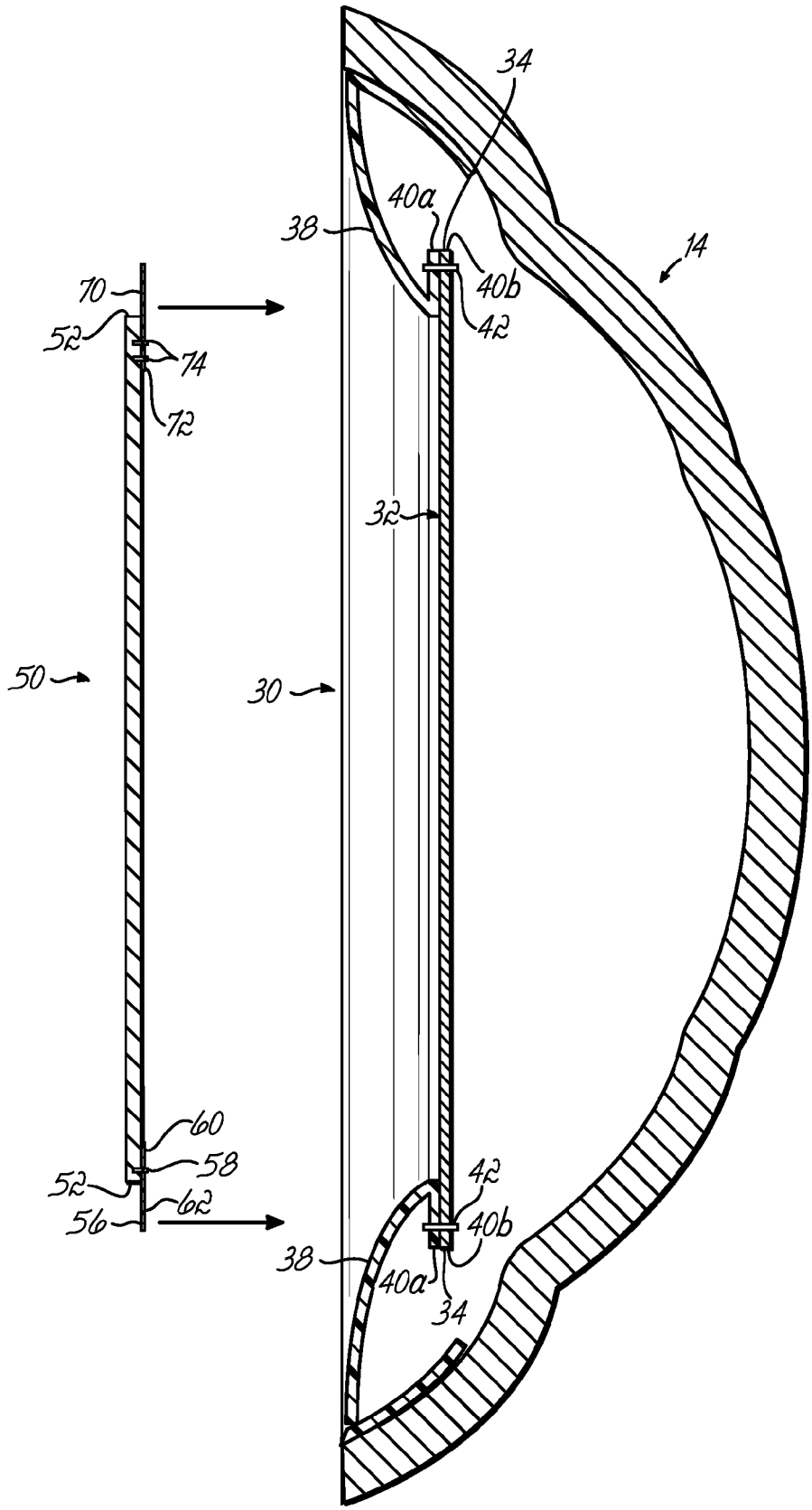
Figure 4B:
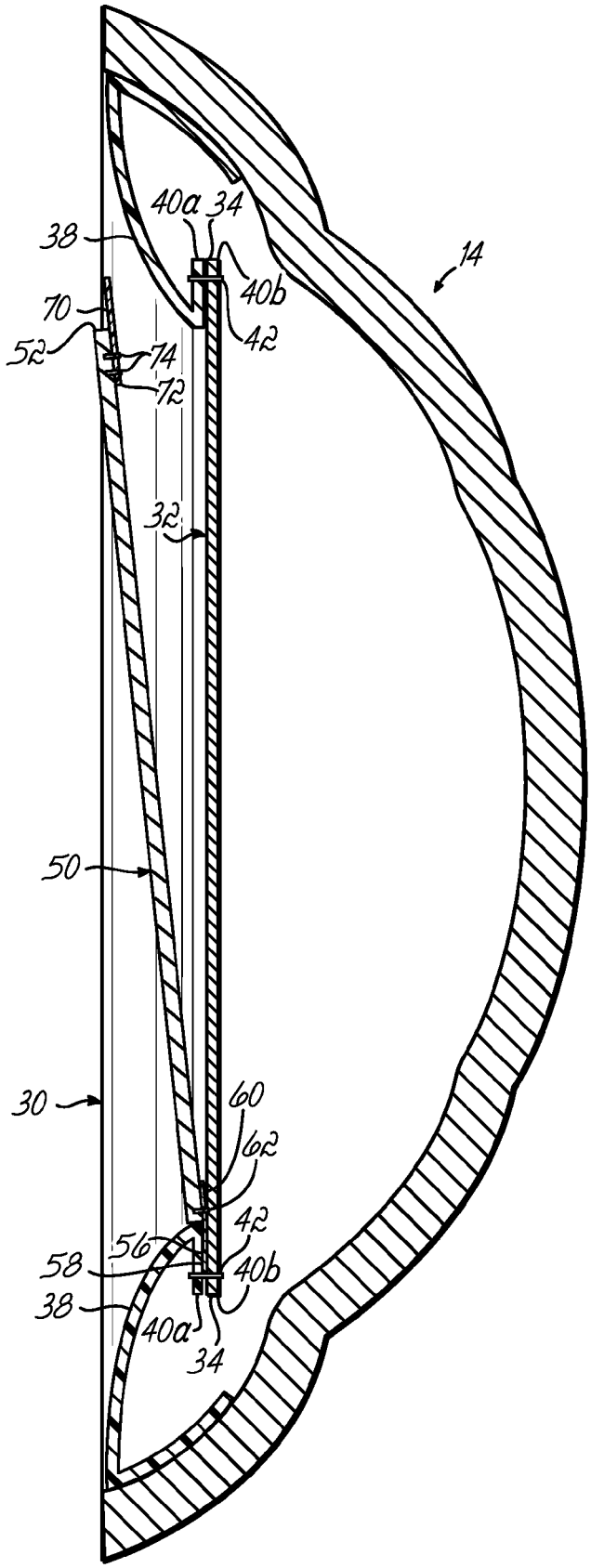
Figure 4C:
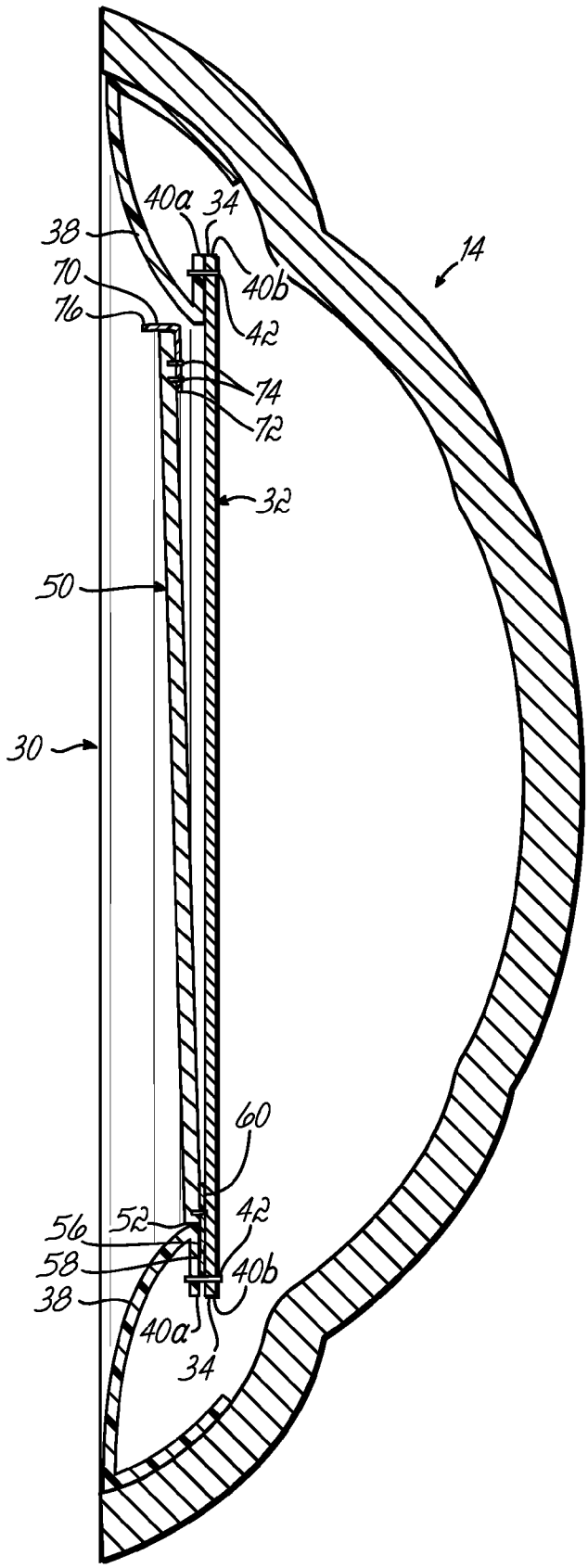
Figure 4D:
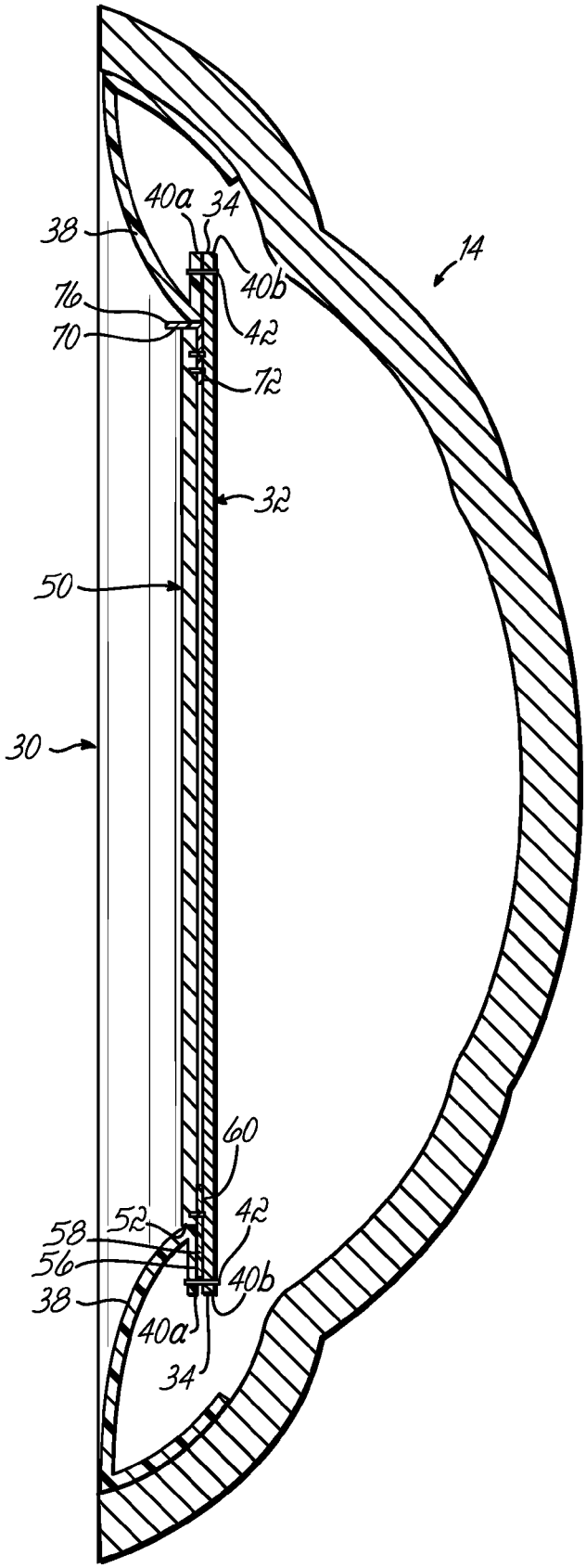

FIG. 1 is a perspective view of a casket embodying the dish assembly of the present invention, FIGS. 2A-2B are views similar to FIG. 1 showing the cap panel insert being installed in the dish assembly in the casket cap, FIG. 3 is a back view of the cap panel insert of FIGS. 1 and 2A-2B, FIGS. 4A-4D are cross sectional views showing the cap panel insert being installed in the dish assembly in the casket cap, and FIGS. 5-8 are additional embodiments of retention and pull members.

DETAILED DESCRIPTION OF THE PREFERRED EMBODIMENT(S) OF THE INVENTION

Referring first to FIGS. 1 and 2A-2B, there is illustrated a casket 10 incorporating the principles of the present invention. The casket 10 includes a shell 12 to which is pivoted one or two caps, for example, as illustrated, a head end cap 14 and a foot end cap 16. The caps 14 and 16 can be pivoted to the shell 12 by conventional means known to those skilled in the art, but not shown in the drawings. The casket 10 can include hardware in the form of a handlebar 20 which can be attached to escutcheon plates 22 which in turn can be attached to the shell 12. The caps 14 and 16 can each include a dish assembly 30 mounted on the underside thereof (only visible in the head end cap 14 in FIG. 1).

Referring now to all the Figures, the dish assembly 30 includes a cap panel 32. Cap panel 32 can be generally rectangular, as is customary and as illustrated, or most any other geometric shape desired. As illustrated, cap panel 32 has a pair of opposed long sides 34, 34 and a pair of opposed short sides 36, 36. A puffing member 38 can be attached to each long side 34 along respective adjacent edges 40*a*, 40*b* as by, for example, staples 42. A puffing member 44 can be similarly attached to each short side 36.

The dish assembly 30 further includes a cap panel insert 50. Cap panel insert 50 can also be generally rectangular, as is customary and as illustrated, or most any other geometric shape desired. It is customary for the size and shape of the cap panel 32 and cap panel insert 50 to be generally the same, though such is certainly not required to practice the invention and the invention is not so limited. As illustrated, cap panel insert 50 has a pair of opposed long sides 52, 52 and a pair of opposed short sides 54, 54.

At least one retention member 56 is fixedly secured to one of the sides 52, 54 of the cap panel insert 50. For example, as illustrated, a pair of retention members 56 can be spaced apart and secured to the lower long side 52. Retention members 56 can be, for example, generally T-shaped tabs, having a vertical member 58 and a horizontal member 60. Horizontal member 60 can be fixedly secured to the back face of the cap panel insert 50 by, for example, staples 62. Upon being installed in the dish assembly 30, the vertical members 58 of the retention members 56 are removably received between the respective adjacent edges 40*a*, 40*b* of puffing member 38 and the cap panel side 34. The free ends 64 of the vertical members 58 of the retention members 56 can be radiused, as illustrated, to facilitate their insertion between the adjacent edges 40*a*, 40*b*.

At least one pull member 70 is fixedly secured to an opposite one of the sides, 52, 54 of the cap panel insert. For example, as illustrated, a pair of pull members 70 can be spaced apart and secured to the upper long side 52. Pull members 70 can be, for example, generally rectangular shaped tabs. At one end 72 the pull members 70 can be fixedly secured to the back face of the cap panel insert 50 by, for example, staples 74. The other free ends 76 of the pull members 70 can be radiused, as illustrated, to reduce the chance of otherwise sharp corners snagging delicate fabric, etc. Upon being installed in the dish assembly 30, the free ends 76 of the pull members 70 project away from the cap panel 32 (i.e. toward an installer). In other words, the free ends 76 of the pull members 70 will be flexed approximately 90 degrees relative to the fixed ends 72 of the pull members 70, and will reside between the edge of the upper long side 52 of the cap panel insert 50 and the puffing 38.

The retention members 56 and the puffing members 38, 44 thus retain the cap panel insert 50 in juxtaposition relative to the cap panel 32, and the pull members 70 thus enable the cap panel insert 50 to be pulled out from between the puffing members 38, 44, away from the cap panel 32, and out of the dish assembly 30. The retention and pull members 56 and 70 can be fabricated of thin sheet plastic which allows them to be resiliently flexed during installation of the cap panel insert 50 into the dish assembly 30.

To assemble the dish assembly 30, the puffing members 38 and 44 are stapled to the sides 34 and 36 of the cap panel 32, respectively, along respective adjacent edges 40*a*, 40*b*. The retention and pull members 56 and 70 are stapled to the upper and lower long sides 52 of the cap panel insert 50. The vertical members 58 of the retention members 56 are inserted between the lower attached puffing 38 and the lower cap panel side 34. The pull members 70 are flexed around the edge of the upper long side 52 of the cap panel insert 50 so as to project away from the cap panel 32 and toward the installer. The cap panel insert 50 is then pressed toward the dish assembly 30 so as to removably insert it between the puffing members 38 and 44 and to place it in juxtaposition relative to the cap panel 32.

To remove the insert 50 to, for example, replace it with one of a different design, the pull members 70 are pulled toward the installer to pivot the upper long side 52 of the insert 50 away from the cap panel, and the insert is pulled upwardly so as to withdraw the vertical members 58 from between the adjacent edges 40*a*, 40*b* of the lower puffing 38 and lower cap panel side 34.

Figure 5:
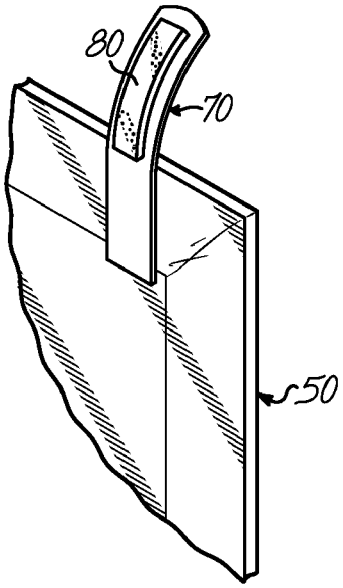

Referring now to FIGS. 5-8, various additional embodiments of the invention are illustrated. In FIG. 5 it will be seen that a strip of foam rubber 80 can be secured to pull tab 70. The strip of foam rubber 80 provides additional friction between the pull tab 70 and the puffing 38 thereby providing more secure retention of the upper edge 52 of cap panel insert 50 in dish assembly 30.

Figure 6:
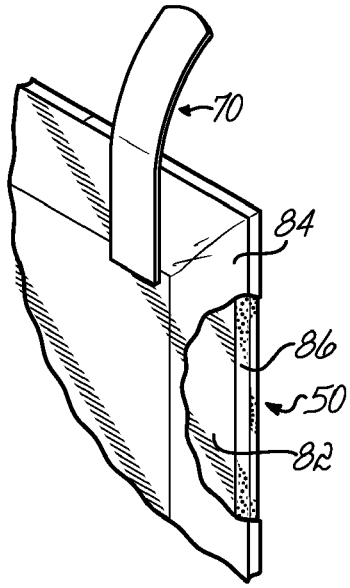

In FIG. 6 it will be seen that the cap panel insert 50 can be constructed of a rigid substrate 82 which can be covered with decorative cloth 84. A strip of open cell poly foam 86 can be positioned around a perimeter of the rigid substrate 82 and secured there by the fabric covering 84, which can be stapled to the rigid substrate 82 on a back face of the substrate 82. The strip of poly foam 86 provides additional friction between the edges 52, 54 of the cap panel insert 50 and the puffing members 38, 44 providing more secure retention of the cap panel insert 50 in the dish assembly 30.

Figure 7:
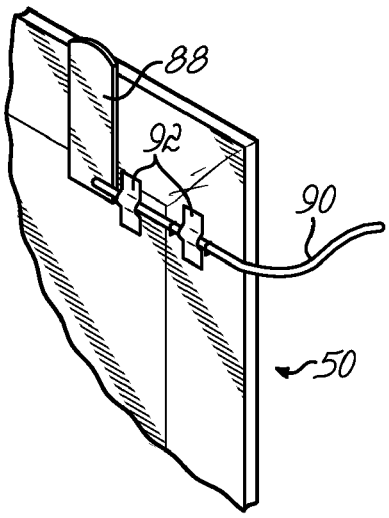

In FIG. 7 it will be seen that a short tab 88 can be used in conjunction with a length of cord, ribbon, etc. 90 on the cap panel insert 50. The short tab 88 provides friction between the cap panel insert 50 and the puffing 38 thereby providing more secure retention of the upper edge 52 of the cap panel insert 50 and the dish assembly 30. The length of cord, ribbon, etc. 90 can be used as the pull member. It can be secured to the back face of the cap panel insert 50, like the prior described tabs 56 and 76, with glue, tape, staples, clips, etc., such as is shown at 92. The pull member 90 can be positioned so as to extend around a side edge 54 of the cap panel insert, as is illustrated, or around a top edge (or bottom edge) 52.

Figure 8:
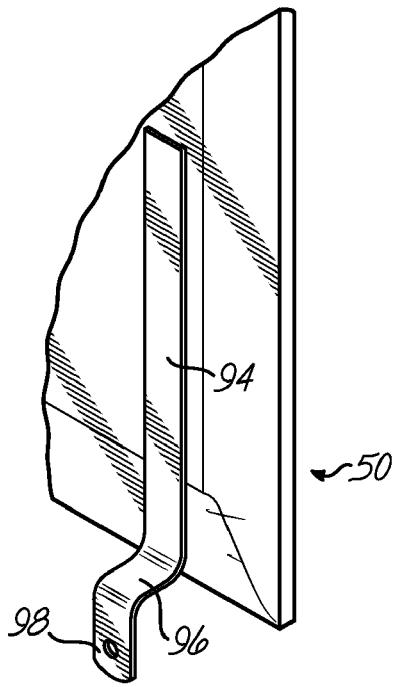

Finally, in FIG. 8 a retention member 94 is illustrated which can take the form of a leg having an offset 96 and a free end 98. This retention member 94 can be fabricated of aluminum to provide additional stiffness over and above that of the plastic tabs. The offset 96 permits this retention member 94 to be used in conjunction with so-called "coved" cap panels 32: a cap panel which includes stuffing between its substrate and decorative cloth covering which makes the forward face of the cap panel assume a convex configuration. The offset 96 permits the free end 98 to be positioned between the lower attached puffing 38 and the lower cap panel side 34, without crushing or otherwise deforming the underlying convex coved cap panel.

The embodiments of the invention shown and described are merely for illustrative purposes only. The drawings and the description are not intended to limit in any way the scope of the invention as defined in the claims. Furthermore, those skilled in the art will readily recognize various changes to, and additional embodiments of, the invention, all of which will fall within the spirit and scope of the invention as defined in the claims. For example, while the retention and pull members have been illustrated as being attached to the upper and lower opposed long sides of the cap panel insert, they could just as well be attached to the left and right opposed short sides of the cap panel insert. By way of further example, while the retention and pull members have been illustrated as being attached to opposite sides of the cap panel insert, they could just as well be attached to adjacent sides of the cap panel insert. By way of yet further example, the pull members could be tabs, cords, ribbons, etc., i.e. any suitable device by which a user could grasp the device and pull the cap panel insert from between the puffing members. All such variations are within the scope of the invention as claimed. Accordingly, the invention is to be limited only by the scope of the following claims and their equivalents.

What is claimed is:

1. A dish assembly for a casket cap comprising:

a cap panel having a pair of opposed sides, a puffing member attached to each side of said pair of sides of said cap panel along respective adjacent edges of said puffing member and cap panel side, a cap panel insert having a pair of opposed sides and being removably inserted between said puffing members and juxtaposed relative to said cap panel, a retention member fixedly secured to one of said sides of said cap panel insert and removably inserted between said respective adjacent edges of one of said puffing members and a respective one of said cap panel sides, and a pull member fixedly secured to the other of said sides of said cap panel insert and projecting away from said cap panel, whereby said retention member and said puffing members retain said cap panel insert in juxtaposition relative to said cap panel, and said pull member enables said cap panel insert to be pulled out from between said puffing members, away from said cap panel, and out of said dish assembly.

2. The dish assembly of claim 1 wherein:

said respective adjacent edges of said puffing members and cap panel sides are secured together with staples, and said retention and pull members are secured to said cap panel insert with staples.

3. The dish assembly of claim 2 wherein said retention and pull members are stapled to a back face of said cap panel insert.

4. The dish assembly of claim 1 wherein said retention and pull members are tabs.

5. The dish assembly of claim 4 wherein said pull tab has a strip of foam rubber secured thereto to provide additional friction between said tab and said puffing member.

6. The dish assembly of claim 1 wherein:

said cap panel is generally rectangular and has a pair of opposed long sides and a pair of opposed short sides, a said puffing member is attached to each side of said pair of long sides and pair of short sides of said cap panel, said cap panel insert is generally rectangular and has a pair of opposed long sides and a pair of opposed short sides, a pair of said retention members are spaced apart and secured to one of said long sides of said cap panel insert, and a pair of said pull members are spaced apart and secured to the other of said long sides of said cap panel insert.

7. The dish assembly of claim 1 wherein said cap panel insert comprises a rigid substrate, a strip of open cell ply foam positioned around a perimeter of said substrate, and a fabric covering securing said foam strip to said substrate, said foam strip providing additional friction between said edges of said cap panel insert and said puffing members.

8. The dish assembly of claim 1 wherein said pull member is a cord and wherein said cap panel insert includes a tab secured thereto adjacent said cord providing additional friction between said cap panel insert puffing member.

9. The dish assembly of claim 1 wherein said retention member is a leg having a first portion secured to said cap panel insert, a second offset portion which projects toward said cap panel, and a third portion which projects downwardly from said offset portion, said leg adapting said cap panel insert to be mounted in said dish when said dish includes a coved cap panel.

10. A casket comprising:

a casket shell, a casket cap pivoted to said shell, and a dish assembly mounted in said cap, said dish assembly comprising:

a cap panel having a pair of opposed sides, a puffing member attached to each side of said pair of sides of said cap panel along respective adjacent edges of said puffing member and cap panel side, a cap panel insert having a pair of opposed sides and being removably inserted between said puffing members and juxtaposed relative to said cap panel, a retention member fixedly secured to one of said sides of said cap panel insert and removably inserted between said respective adjacent edges of one of said puffing members and a respective one of said cap panel sides, and a pull member fixedly secured to the other of said sides of said cap panel insert and projecting away from said cap panel, whereby said retention member and said puffing members retain said cap panel insert in juxtaposition relative to said cap panel, and said pull member enables said cap panel insert to be pulled out from between said puffing members, away from said cap panel, and out of said dish assembly.

11. The casket of claim 10 wherein:

said respective adjacent edges of said puffing members and cap panel sides are secured together with staples, and said retention and pull members are secured to said cap panel insert with staples.

12. The casket of claim 11 wherein said retention and pull members are stapled to a back face of said cap panel insert.

13. The casket of claim 10 wherein said retention and pull members are tabs.

14. The casket of claim 10 wherein:

said cap panel is generally rectangular and has a pair of opposed long sides and a pair of opposed short sides, a said puffing member is attached to each side of said pair of long sides and pair of short sides of said cap panel, said cap panel insert is generally rectangular and has a pair of opposed long sides and a pair of opposed short sides, a pair of said retention members are spaced apart and secured to one of said long sides of said cap panel insert, and a pair of said pull members are spaced apart and secured to the other of said long sides of said cap panel insert.

15. A method of assembling a dish assembly for a casket cap comprising the steps of:

providing a cap panel having a pair of opposed sides, providing at least two puffing members, attaching one of the puffing members to each of the pair of sides along respective adjacent edges of the puffing member and side, providing a cap panel insert having a pair of opposed sides corresponding to the cap panel opposed sides, providing a retention member and fixedly securing the retention member to one of the sides of the cap panel insert, providing a pull member and fixedly securing the pull member to the other of the sides of the cap panel insert, removably inserting the retention member between the respective adjacent edges of one of the puffing members and a respective one of the cap panel sides, projecting the pull member away from the cap panel, and removably inserting the cap panel insert between the puffing members and juxtaposing the cap panel insert relative to the cap panel.

16. The method of claim 15 wherein the cap panel and cap panel insert are generally rectangular.

17. The method of claim 15 wherein the retention and pull members are tabs.

18. A dish assembly for a casket cap comprising:

a cap panel having a first side and a second side opposite said first side, and a third side and fourth side opposite said third side, a puffing member attached to each said side of said cap panel along respective adjacent edges of said puffing member and cap panel side, a cap panel insert having a first side and a second side opposite said first side, and a third side and a fourth side opposite said third side, a retention member fixedly secured to said first side of said cap panel insert and removably inserted between said respective adjacent edges of one of said puffing members and a respective one of said cap panel sides, and a pull member fixedly secured to one of said second, third, and fourth sides of said cap panel insert and projecting away from said cap panel, whereby said retention member and said puffing members retain said cap panel insert in juxtaposition relative to said cap panel, and said pull member enables said cap panel insert to be pulled out from between said puffing members, away from said cap panel, and out of said dish assembly.

19. The dish assembly of claim 18 wherein said pull member is secured to said second side of said cap panel insert.

20. The dish assembly of claim 18 wherein said pull member is secured to said third side of said cap panel insert.

21. The dish assembly of claim 20 wherein said pull member is a cord.

22. The dish assembly of claim 18 wherein said pull member is secured to said fourth side of said cap panel insert.

23. The dish assembly of claim 22 wherein said pull member is a cord.

24. The dish assembly of claim 18 wherein said cap panel and said cap panel insert are generally rectangular.

25. The dish assembly of claim 18 wherein said retention and pull members are tabs.

* * * * *